United States Patent [19]

Gattus

[11] 4,181,076

[45] Jan. 1, 1980

[54] INK RETURN CIRCUIT FOR A FLEXOGRAPHIC PRINTING MACHINE

[75] Inventor: Yves Gattus, Villeurbanne, France

[73] Assignee: S.A. Martin, Villeurbanne, France

[21] Appl. No.: 911,142

[22] Filed: May 31, 1978

[30] Foreign Application Priority Data

Jun. 3, 1977 [FR] France ..... 77 16948

[51] Int. Cl.[2] ..... B41F 31/02; B41L 27/04

[52] U.S. Cl. ..... 101/350; 101/363; 101/364; 101/366

[58] Field of Search ..... 101/350, 363, 364, 366, 101/365, 207, 208, 210, 315, 321, 326, 330, 340, 341, 344, 347, 360, 361, 148, 157, 169; 118/259, 261, 262; 241/222, 226, 227, 229

[56] References Cited

U.S. PATENT DOCUMENTS 2,218,945 10/1940 Andersson ..... 101/364

2,887,050 5/1959 Moser et al. ..... 101/364

2,922,364 1/1960 Nitchie et al. ..... 101/364

FOREIGN PATENT DOCUMENTS 711346 6/1954 United Kingdom ..... 101/363

*Primary Examiner*—J. Reed Fisher

*Attorney, Agent, or Firm*—Haseltine, Lake & Waters

[57] ABSTRACT

The ink return circuit of a flexographic printing machine, for receiving ink from the ends of the gutter formed by a stereo transfer roller and a pressure regulating roller, comprises, at each end of the rollers, a vertical deflecting spout for receiving ink from the gutter, each spout having three doctor blades comprising a first blade extending substantially along the line of centers of the rollers and inclined to form an overflow and two lateral blades extending perpendicular to the first blade and to the end faces of the rollers. The spouts are biased against the end faces of the rollers and form part of a set of interchangeable spouts.

2 Claims, 3 Drawing Figures

FIG 3
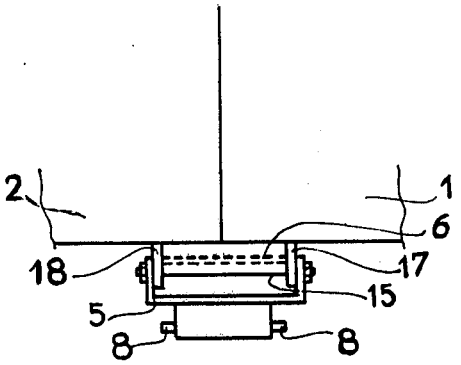
FIG 2
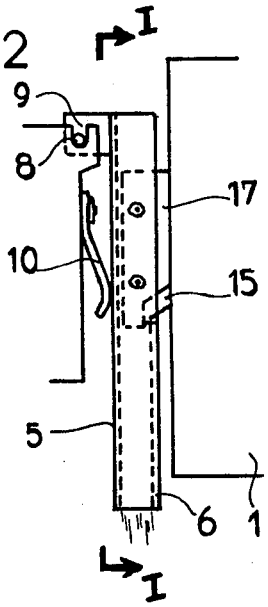
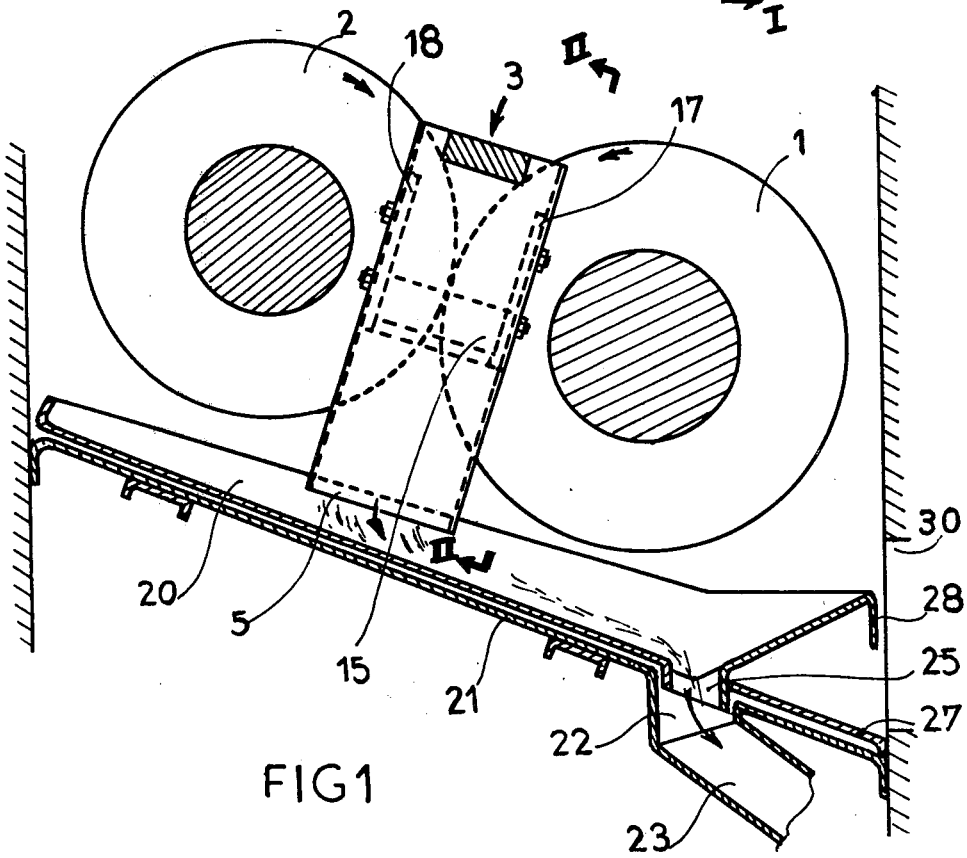
FIG1

INK RETURN CIRCUIT FOR A FLEXOGRAPHIC PRINTING MACHINE

BACKGROUND OF THE INVENTION

The present invention relates to an improvement to the ink return circuit of a flexographic printing machine, and particularly but not exclusively to a flexographic printing station on a printer-slotter for the manufacture of corrugated cardboard packaging boxes.

In the manufacture of corrugated cardboard packaging boxes the blank sheets produced by the corrugating machine are subsequently finished by cutting and printing on a machine usually called a printer-slotter. Depending on the nature of the prints to be produced, the printing stations of these machines are either fatty-ink printing stations or so-called flexographic stations which use inks which are diluted with water and have a very fluid consistency.

In flexographic printing machines using a very fluid ink, the ink is generally spread between a screen roller or a ceramic roller, which retains a small amount of ink to be deposited on the stereo, and a rubber roller which makes it possible to regulate the amount of ink retained by regulating the pressure of the rubber roller against the screen roller. The ink is thus introduced in excess between the two rollers and the excess is removed by overflowing at the two ends of the gutter formed by the two rollers which are in contact. The excess ink is collected in a recovery trough from which it is passed to a reservoir and recycled.

However, the flow of ink at the ends of the rollers, though it is often in the form of a jet, always leads, through trickling or through a surface tension phenomenon, to the presence of ink on the plane end faces of the rollers, and as a result of the centrifugal effect of the rotation of the rollers, beads form at the ends of the inking surfaces of the rollers. These beads dry and harden, and finally interfere with the correct application of the rollers against one another, and hence interfere with the regulation of the inking.

Furthermore, the ink falling into the recovery trough produces a spray which also dries and rapidly forms solid deposits on the walls. This produces difficulties in washing when changing the ink, the washing being carried out by circulating clean water through the ink feed lines and recycling lines. The solidified beads and deposits are in fact slow in redilute, which results in a lengthening of the washing time and in excessive consumption of washing water.

It is an object of the present invention to overcome the above disadvantages and hence to improve the inking regulation, and the washing conditions, of a flexographic printing machine.

SUMMARY OF THE INVENTION

According to the invention there is provided a device for use in the ink return circuit of a flexographic printing machine comprising means for feeding ink into the gutter formed by a stereo transfer roller and a pressure-regulating roller, excess ink overflowing at the ends of said rollers into said return circuit, said device comprising:

a set of interchangeable deflecting spouts;

means for removably mounting one of these spouts at each end of the inking rollers and between the journals thereof;

and means for holding each of these spouts under pressure against the respective end faces of said rollers;

each of these spouts including three doctor blades, a central doctor blade extending substantially along the line of the centers of the rollers and inclined to form an overflow, and two lateral doctor blades extending at right angles to said central doctor blade and to the end face of the rollers.

According to a preferred embodiment of the invention, the printing machine furthermore comprises means for receiving, under each deflecting spout, a removable receiving trough which is interchangeable within a set with which the printing machine is equipped, each interchangeable trough possessing a lower outlet orifice which, when the trough is in position on its supports, opens into the inlet of a fixed ink return tube, the trough thus forming the second unit of the ink return circuit.

The invention will be more fully understood from the following description of an embodiment thereof, given by way of example only, with reference to the accompanying drawings.

BRIEF DESCRIPTION OF THE DRAWINGS

In the drawings:

FIG. 1 is a simplified view of an embodiment of a device according to the invention in position at one end of the inking rollers, and on the line I—I of FIG. 2;

FIG. 2 is a side view of the deflecting spout shown in FIG. 1 and on the line II—II of FIG. 1; and FIG. 3 is a top view of the spout of FIG. 2.

DESCRIPTION OF THE PREFERRED EMBODIMENTS

Referring to the drawing, the usual arrangement of the inking rollers 1, 2 of a flexographic printing machine is shown, two rollers 1, 2 rotating in opposite directions. The roller 1 is a screen roller or ceramic roller which deposits ink on the stereo carried by a stereo cylinder which is not shown. The roller 2 is a rubber-covered roller whose pressure against the roller 1 can be regulated in order to regulate the amount of ink transferred to the stereo by the screen roller 1. Ink is poured at 3, in the usual manner for this type of machine, into the gutter formed by the two rollers which are in contact, and the excess is removed by overflowing at the two ends of the gutter.

The ink which overflows is received by a deflecting spout 5, which has a U-shaped section in its upper part, while in the lower part it forms a channel which is closed by a metal sheet 6. The spout 5 is held in position against the end faces of the rollers 1 and 2 by lugs 8 which are engaged in notches 9 of a component of the framework of the machine. Spring 10 maintains the spout under slight pressure against the rollers. The spout 5 is provided with three doctor blades which extend beyond the opening of the spout and bear against the end face of the rollers, under the pressure of the spring 10.

The first doctor blade 15 is arranged parallel to the line of the centers of the rollers 1 and 2, and very slightly below this line. The doctor blade 15 is slightly inclined, in the form of an overflow. On either side of the doctor blade 15 there are two lateral doctor blades 17 and 18, at right angles to the doctor blade 15. The set of the three doctor blades thus forms an overflow channel, at the end faces of the rollers, which terminates in the closed lower part of the spout 5. The three doctor blades 15, 17 and 18 thus wipe the whole of the peripheral part of the plane end faces of the rollers 1 and 2. The closed channel consisting of the lower part of the spout 5 opens into a removable recovery container or trough 20 which, in the normal operating position as shown in FIG. 1, rests on an inclined metal sheet 21 firmly fixed to the framework of the printing machine. The metal sheet 21 possesses an orifice 22 connected to a tube 23 which leads to the ink recovery reservoir. The trough 20 possesses a short outlet tube 25 and when the trough 20 is in the normal position in the printing machine, locked in position by an extension 27 which abuts against a component of the framework of the machine, the tube 25 enters the fixed tube 22 so that the flow of ink issuing from the spout 5 is directly led into the tube 23 and from there to the ink recovery reservoir.

It will be noted first of all that the system of the doctor blades of the spout 5 avoids overflowing and spraying of excess ink, and in particular avoids the formation of beads because the ink is no longer retained on the end faces of the rollers. Spraying is also avoided by the channelling of the flow of ink inside the spout 5.

Furthermore, the ink issuing from the spout 5 flows directly in the recovery trough 20 which alone receives any spray of ink.

When a change of ink is made, the only parts of the circuit which may carry dried ink spray is thus the spout 5 and/or the trough 20. It thus suffices to remove both spout 5 and trough 20 and replace them immediately by another clean spout and another clean trough, thereby restricting to the minimum the printing machine washing operations before inking up with a different color. The handling of the trough 20, for the purpose of removing it or placing it in position, is facilitated by the handle 28.

The soiled trough is removed, and the clean trough put into position, through an opening 30 in the framework of the machine.

The dried ink deposits on the spout 5 and the trough 20 can be cleaned off in another part of the factory, for example after soaking, which considerably reduces the amount of water or of solvent required for washing.

Of course the invention is not strictly limited to the embodiment which has just been described by way of example only, but also embraces embodiments which only differ therefrom in details, in variations in execution or in the use of equivalent means. In particular the devices for anchoring the spout 5 and for keeping it under pressure against the rollers, could be replaced by other means. Equally, the shape and arrangement of the recovery trough 20 can be modified taking into account the particular arrangement of the printing machine, provided this trough is easily removable and provided that, in the working position, it directly leads the flow of return ink to the return pipelines which lead to the reservoir.

What is claimed is:

1. A device for use in the ink return circuit of a flexographic printing machine comprising means for feeding ink into the gutter formed by a stereo transfer roller and a pressure-regulating roller, excess ink overflowing at the ends of said rollers into said return circuit, said device comprising:

a set of interchangeable deflecting spouts;

means for removably mounting one of said spouts at each end of the inking rollers and between the journals thereof;

and means for holding each of said spouts under pressure against the respective end faces of said rollers, each of said spouts including three doctor blades comprising a central doctor blade extending substantially along the line of the centers of the rollers and inclined to form an overflow, and two lateral doctor blades extending at right angles to said central doctor blade and to the end face of the rollers.

2. A device according to claim 1, further comprising means for receiving a removable ink receiving trough and arranged under each deflecting spout, and a set of interchangeable troughs, each trough having a lower outlet orifice which, when said trough is in position on said receiving means, opens into an inlet of a fixed ink return tube.

* * * * *